US008919790B2

(12) United States Patent
Reguis et al.

(10) Patent No.: US 8,919,790 B2
(45) Date of Patent: Dec. 30, 2014

(54) GLIDING BOARD

(71) Applicant: Skis Rossignol, Saint-Jean de Moirans (FR)

(72) Inventors: Adrien Reguis, Grenoble (FR); Arnaud Repa, Le Fontanil Cornillon (FR)

(73) Assignee: Skis Rossignol, Saint-Jean de Moirans (FR)

( * ) Notice: Subject to any disclaimer, the term of this patent is extended or adjusted under 35 U.S.C. 154(b) by 0 days.

(21) Appl. No.: 13/744,877

(22) Filed: Jan. 18, 2013

(65) Prior Publication Data

US 2013/0187351 A1 Jul. 25, 2013

(30) Foreign Application Priority Data

Jan. 19, 2012 (FR) ..... 12 50568

(51) Int. Cl.
*A63C 5/04* (2006.01)
*A63C 5/07* (2006.01)

(52) U.S. Cl.
CPC ..... *A63C 5/0405* (2013.01)
USPC ..... 280/28; 280/14.21; 280/601; 280/602; 280/609; 441/68

(58) Field of Classification Search
None
See application file for complete search history.

(56) References Cited

U.S. PATENT DOCUMENTS

| | | | | |
|---|---|---|---|---|
| 2008/0042400 | A1 * | 2/2008 | Smith et al. | 280/609 |
| 2008/0106068 | A1 * | 5/2008 | Drake et al. | 280/601 |
| 2008/0116662 | A1 * | 5/2008 | Bourgier et al. | 280/609 |
| 2011/0169248 | A1 * | 7/2011 | Puget et al. | 280/601 |

FOREIGN PATENT DOCUMENTS

| | | | |
|---|---|---|---|
| DE | 4112950 | A1 | 11/1991 |
| DE | 202004005784 | U1 | 6/2004 |
| EP | 1935459 | A1 | 6/2008 |
| FR | 2786108 | A1 | 5/2000 |
| WO | WO 03072207 | A2 * | 9/2003 |
| WO | WO-2003072207 | A2 | 9/2003 |

OTHER PUBLICATIONS

Republique Francais, Rapport De Recherche Preliminaire for Corresponding French Application No. 1250568 in the French Language dated Oct. 9, 2012 (2 pgs).

* cited by examiner

*Primary Examiner* — J. Allen Shriver, II
*Assistant Examiner* — Hilary L Johns
(74) *Attorney, Agent, or Firm* — Harris Beach PLLC

(57) ABSTRACT

A snow gliding board, including front and rear lines of maximum width, and having sidecuts including a central area having a curvature directed towards the outside of the board, wherein said central area extends towards the front and/or the back in an adjacent area having a curvature oriented toward the inside, which extends at least all the way to the respective front and/or rear line of maximum width.

31 Claims, 2 Drawing Sheets

GLIDING BOARD

CROSS-REFERENCE TO RELATED APPLICATIONS

This application claims the benefit of French Patent Application No. 1250568, filed on Jan. 19, 2012. The entirety of this application is incorporated herein by reference.

BACKGROUND

The present disclosure relates to the field of snow gliding sports. It more specifically aims at gliding boards having sidecuts with a specific geometry to improve the controllability and the user-friendliness of the board. It may apply to various type of gliding boards, be they skis or snowboards.

DISCUSSION OF PRIOR ART

Generally, a gliding board, be it a ski or a snowboard, has a sidecut, defined in standard fashion as being the line which follows the lateral contour of the ski in the area located between the front and rear points of maximum width.

Conventionally, and as illustrated in document WO 03/072207, the sidecut of a ski is hollowed, so that the mid-length ski width, or its width close to the shoe midline, is smaller than the width at the level of the front and/or rear points of maximum width.

Hollowing this sidecut enables to define a radius of curvature, which may be on the order of a few meters, or even of a few tens of meters. Due to the sidecut hollowing, the curvature has its center towards the outside of the board. According to the desired geometry, the radius of curvature may be substantially constant, or more generally varying along the sidecut, and generally reaching a minimum level in the middle of the board.

The same configuration can be observed on a snowboard, such as described in document DE 2004 005 784 U1.

An alternative embodiment has been described in document DE 41 12 950. The ski described in this document has two aligned rectilinear areas located close to the widest areas at the front and at the back of the ski. More specifically, such a ski has a central area with a curvature conventionally facing outwards. At the front and at the back of this central area, the sidecut has rectilinear portions aligned with each other, and which thus form a line slightly inclined with respect to the longitudinal axis of the ski. The connection between the central area with an outward-facing curvature and the rectilinear areas is performed by short portions having their curvature directed towards the inside of the ski, and which end at the beginning of the rectilinear portion, that is, before the widest area.

These different gliding boards have a similar behavior, observed when the ski is placed on its edge. Indeed, when the user starts a bend and inclines the board with respect to the trail, the stress is mainly exerted at the points of maximum width.

These areas where the load pressure is thus greater form privileged grip points which require a good mastery of the board practice to make it pivot. In certain cases, too much grip may adversely affect the turn linking ease or rapidity.

There thus is a need to decrease the impact of overpressures exerted at certain points of the sidecut, in particular at the widest points of the board, at the starting of or while performing turns.

DISCUSSION OF THE INVENTION

The present invention thus relates to a snow gliding board, comprising front and rear lines of maximum width, and having sidecuts comprising a central area having a curvature directed towards the outside of the board.

According to the present invention, this board is characterized in that this central area extends towards the front and/or towards the back in an adjacent area having a curvature directed towards the inside of the board, this adjacent area extending at least all the way to the respective front and/or rear line of maximum width.

In other words, the boards according to the present invention are designed so that the front and/or rear areas of maximum width are located in an area where the curvature of the sidecut is facing the inside. This inside-facing curvature area starts ahead of the waist, and far before the wide point. Accordingly, when the ski is laterally inclined, for example, when initiating a turn, the efforts are transmitted to the ground by a fraction of the area of reversed curvature, over a sufficient length for the exerted pressure to be decreased. As a result, the grip of the edge is lighter than in board end areas. Of course, the length of this adjacent area must be sufficient to generate this effect on the pressure exerted by the edge. This adjacent area should thus start sufficiently far before the widest point to extend all the way to this wide point, and even beyond. It should thus not be confused with a simple connection area located in the immediate vicinity of the wide point, where the outward-facing curvature at the waist level reverses, to be facing the inside, beyond the widest point.

In other words, as the board becomes more and more laterally inclined, the contact with the snow progressively and continuously distributes over a sufficiently long area, before the wide points, to avoid for the edge to exert too strong a pressure on the snow at the wide points.

In practice, different geometries may be used, according to the length of the tip raising. Thus, in a first variation, the front contact line may be located in the adjacent area, having a reversed curvature, and for example close to the front line of maximum width, for a board having a light tip raising. This may mainly occur when gliding on a trail, on packed snow, which enables to obtain a more user-friendly and controllable board.

In another variation, the front and/or rear contact line may also be located in the adjacent area, having a sidecut of reversed curvature, but in an intermediate region of this adjacent area, lengthwise. This enables to achieve a favorable behavior for a versa-tile board on packed and powder snow.

In another alternative embodiment corresponding to a board with a strongly raised tip, the front contact line may be located before the adjacent area, that is, inside of the central area where the curvature of the sidecut faces the outside. This board is more specifically dedicated to a gliding on powder snow.

Advantageously, the length of the adjacent area located before the wide point must be sufficient to substantially decrease the overpressure usually existing at the widest points of the sidecut. In practice, the length of the adjacent area, measured parallel to the longitudinal axis of the board, is greater than 100, or even than 120 mm Due to such a length, when the ski is inclined, the pressure distribution in the adjacent area is decreased with respect to conventional skis and in particular, in the corresponding edge area, the skier feels no exaggerated grip which might disturb him in terms of ski controllability.

In practice, the presence of the adjacent area, having its curvature directed towards the inside, along a sufficient length, translates as a widening of the board between the inflexion point of the sidecut, where the curvature passes from an external to an internal orientation, and the widest point, which is located inside of this adjacent area. Typically, this width increase on one side of the board, between these two points, is greater than 5 millimeters, and may reach 10 mm or even more according to the board configuration. This widening may be assessed separately from one side to the other of the board by a measurement with respect to the longitudinal axis of the board.

More generally, and according to a criterion which may be transposed to different types and lengths of boards, it will be preferred for the length of the adjacent area before the wide point to be greater than 10% of the length measured between the front and rear wide points of the sidecut.

In practice, the central area, that is, the area having a curvature directed towards the outside, has its length decreased, since a portion of the sidecut is located in the areas said to be adjacent, having a reversed curvature, so that it is possible to adopt radiuses of curvature in the central area which are shorter than the radiuses conventionally observed for boards of similar length.

Advantageously, in practice, the radius of curvature of the central area ranges between 5 and 20 meters. In the specific case of an alpine ski, this radius may advantageously be smaller than 15 meters. In the case of a snowboard, this radius of curvature of the central area is advantageously smaller than or equal to 8 meters.

Generally, whatever the type of boards, the radius of curvature of the adjacent area is greater than the radius of curvature of the central area, and advantageously ranges between 15 and 30 meters.

BRIEF DESCRIPTION OF THE DRAWINGS

The way to implement the present invention, as well as the resulting advantages, will better appear from the description of the following embodiments, in relation with the accompanying drawings.

Figure 1:
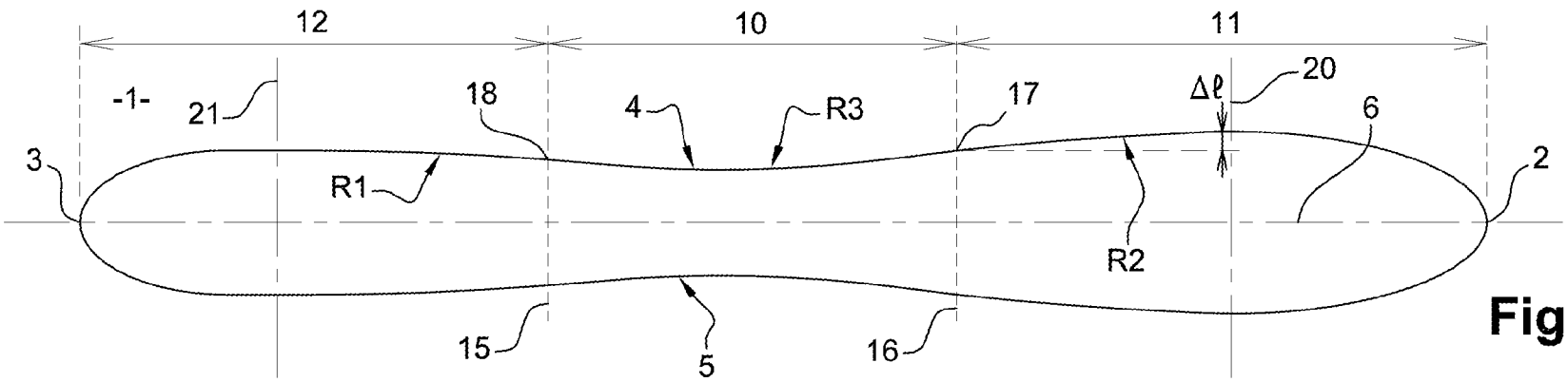
FIG. 1 is a top view of a ski according to a first embodiment of the present invention.

The board dimensions and proportions illustrated in the drawings may differ from reality, and may have been exaggerated to ease the understanding of the present invention.

DESCRIPTION OF EMBODIMENTS

As illustrated in FIG. 1, ski 1 has a front end 2 and a rear end 3. This ski also has sidecuts 4, 5 which are symmetrical with respect to median longitudinal axis 6 of the board.

According to the present invention, ski 1 has a central area 10, which extends longitudinally between two lines 15, 16, respectively located at the front and at the back of the binding implantation area.

In central area 10, sidecut 4, 5 has an externally-oriented curvature. The length of the central area, measured parallel to the median longitudinal axis, ranges between 50 and 90% of the length measured between wide points 20, 21.

The sidecut curvature in area 10 is externally oriented, and the value of radius of curvature R3 may be constant, with a relatively low value, on the order of 15 meters or less at the median level of the central area. This radius of curvature may also be variable along the length of the central area, it being understood that the average radius, calculated from the two end points of the central area and from the narrowest point of the board, is on the order of 15 meters. A relatively small radius of curvature, with this reversed curvature sidecut, may be envisaged for all skis having a minimum waist width ranging between 55 and 180 mm. This type of sidecut is particularly advantageous for skis having a width greater than 100 mm Thereby, relatively wide skis, having their width mainly provided for skiing in powder snow, then become easier for slope skiing where the snow is harder due to its packing.

Ahead of central area 10, the ski has an adjacent area 11 where sidecut 4 has a curvature directed towards the inside of the board. This adjacent area extends from line 16 to front end 2 of the board. The connection point between central area 10 and adjacent area 11 corresponds to inflexion point 17, where the sidecut curvature changes direction.

It should be noted that the sidecut may be non-significant in the case where the end of the board is equipped with tips or has a specific geometry. Anyway, front adjacent area 11 encompasses the region of maximum width located at the front of the board, materialized by line 20 in FIG. 1.

Radius of curvature R2 in the portion of adjacent area 11 located before wide point 20 is greater than that R3 observed in central area 10 and, for a ski, typically ranges between 15 and 30 meters. In the same way as for the central area, radius R2 may be constant along the entire length of the adjacent area or preferentially be variable. Beyond wide point 20, the adjacent area has a radius of curvature that may be smaller.

In practice, the portion of adjacent area 11 located to the back of the line of maximum width 20 has a length greater than 120 mm, capable of reaching 300 mm according to the general geometry of the board. The length of the adjacent area is generally greater than 10% of the length measured between the two wide points 20, 21. Along the length of adjacent area 11 located to the back of the line of maximum width, the ski widens, between its beginning, corresponding to inflexion point 17 of the sidecut, and wide point 20. Typically, this widening $\Delta l$, measured perpendicularly to the longitudinal axis, is greater than 5 millimeters, and may reach values of 10 mm, or even more.

In the shape illustrated in FIG. 1, the ski has an adjacent area 12, to the back of central area 10, also having an outward-oriented sidecut curvature. This adjacent area connects to central area 10 and starts at the beginning of line 15, where inflexion point 18 of the sidecut is located, and extends towards the back at least all the way to rear wide point 21. However, the presence of such a rear adjacent area of reversed curvature is not really compulsory.

Figure 2:
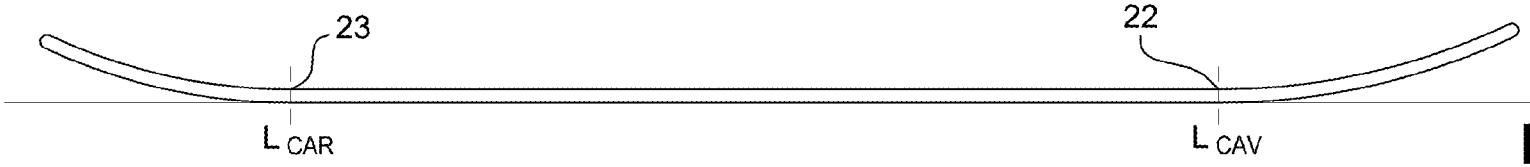
FIG. 2 is a side view of the ski of FIG. 1, shown to be loaded at its center.

As illustrated in FIG. 2, ski 1 has a front contact line 22, defined in standardized fashion when the board is loaded at its center, and extends on a horizontal plane. In the shape illustrated in FIG. 2, front contact line 22 is located slightly to the back of line 20 of maximum width in the adjacent area of the sidecut, where the radius of curvature is reversed. More specifically, front contact line 22 is closer to line 20 of maximum width than to line 16 of reversal of the curvature direction.

Similarly, rear contact line 23 is located slightly ahead of line 21 of maximum width.

Figure 3:
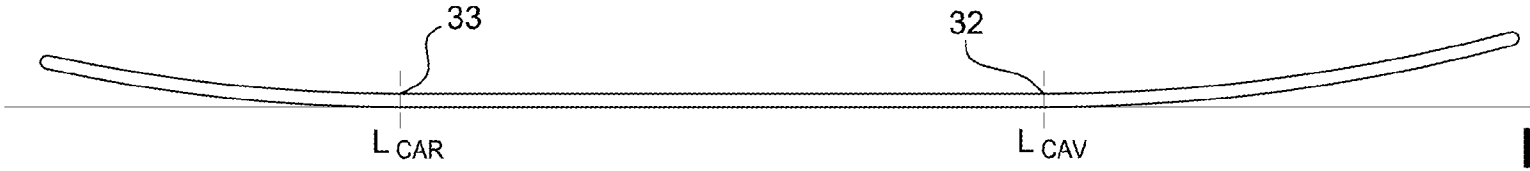
FIGS. 3 and 4 are side views of alternative embodiments for skis having different load-bearing lengths.

Thus, in the embodiment of FIG. 3, front contact line 32 is located more to the back than front contact line 22 of the board of FIG. 2. More specifically, front contact lien 32 is located closer to line 16 of reversal of the curvature direction than to the point of line 20 of maximum width. Thus, in the embodiments of FIGS. 2 and 3, it should be noted that front contact line 22, 32 is located beyond line 16 of reversal of the curvature direction.

Figure 4:
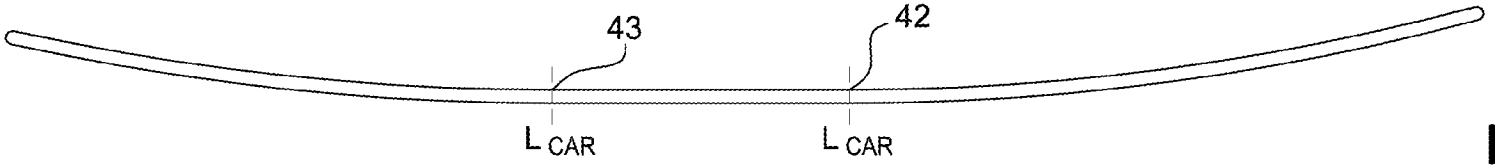

In the embodiment of FIG. 4, front contact line 42 is located inside of the central area, that is, to the back of line 16 of reversal of the sidecut curvature direction.

In FIGS. 3 and 4, rear contact lines 33 and 43 are located similarly to the front contact line, that is, close to the front and/or to the back of line 15 of reversal of the curvature direction. However, the different embodiments illustrated in FIGS. 2, 3, and 4 may be combined without departing from the context of the present invention.

Figure 5:
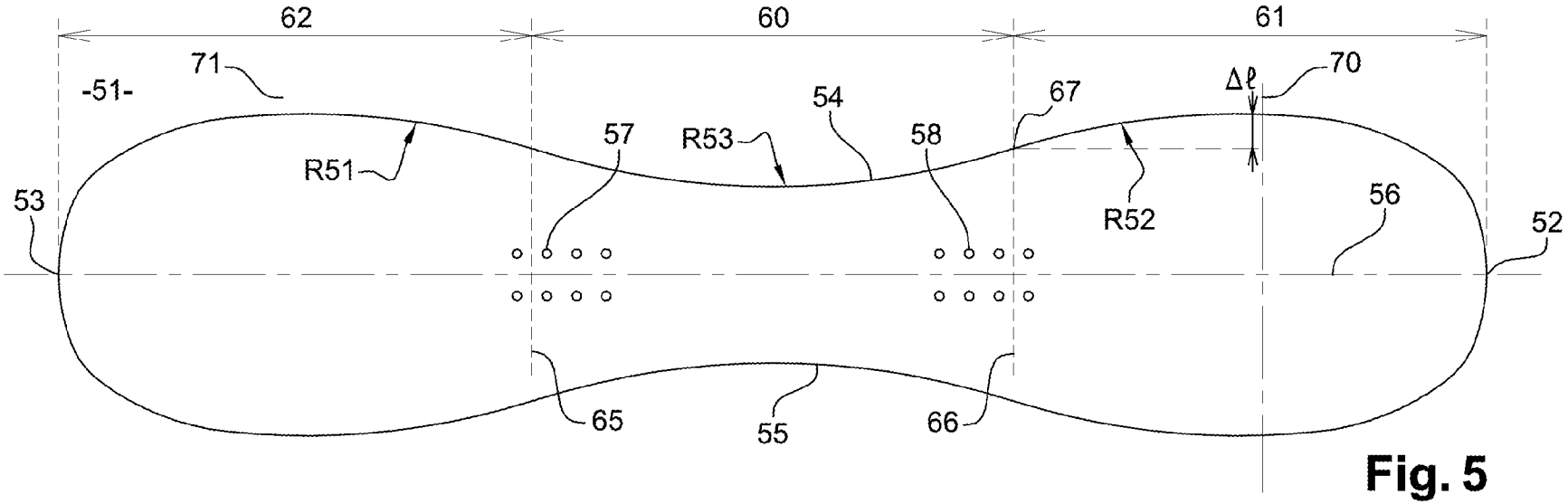
FIG. 5 is a top view of a snowboard according to a second embodiment.

The embodiment illustrated in FIG. 5 corresponds to a snowboard. Such a snowboard 51 has a front end 52 and a rear end 53.

This snowboard also has sidecuts 54, 55 which are symmetrical with respect to median longitudinal axis 56 of the board.

According to the present invention, snowboard 51 has a central area 60 which extends longitudinally between two lines 65, 66 respectively arranged close to areas 57, 58 of implantation of the bindings, materialized in the drawing by the position of the metal inserts for assembling the binding.

In central area 60, sidecut 54, 55 has an externally-oriented curvature. The length of central area 60 preferably ranges between 40 and 90% of the length measured between wide points 70, 71.

The curvature of sidecut 54, 55 in central area 60 is facing the outside, and the value of radius of curvature R52 may be constant, with a value on the order of a few meters and typically smaller than 8 meters, or even smaller than 6 meters. The value of the radius of curvature may also be variable along the length of the central area.

Ahead of central area 60, the snowboard has a front adjacent area 61 where side-cut 64 has a curvature directed towards the inside of the snowboard. Adjacent area 61 extends from line 66 where the sidecut curvature reverses to front end 52 of the snow-board. The features of the present invention associated with the sidecut definition may be non-significant in the case where the end area of the board has a defined shape for aesthetic reasons, since this area is not in contact with the snow when the board is inclined.

Generally, front adjacent area 61 encompasses the region of maximum width located at the front of the board, materialized by line 70 in FIG. 5.

Radius of curvature R52 in adjacent area 61 is greater than that R53 observed in the central area and, for a snowboard, typically ranges between 15 and 25 meters. In the same way as for central area 60, radius R53 may be constant along the entire length of adjacent area 61 or may preferentially be variable.

As illustrated in FIG. 5, the portion of front adjacent area 61 located to the back of line 70 of maximum width has a length greater than approximately 10% of the length measured between wide points 70, 71. In practice, the length of this area is greater than 120 mm, and may reach 300 mm according to the general geometry of the board. Along the length of adjacent area 61 located to the back of the line of maximum width, the board widens, between its beginning, corresponding to inflexion point 67 of the sidecut, and wide point 70. Typically, such a widening $\Delta l$, measured perpendicularly to the longitudinal axis, is greater than 5 millimeters, and may reach values of 10 mm, or even more.

In the illustrated form, the back of the board has an adjacent area 62 similar to area 61. In the case of a snowboard, it is preferable for the board to have two adjacent areas located on either side of the central area, although embodiments with a single adjacent area of reversed curvature are also within the field of the present invention.

Figure 6:
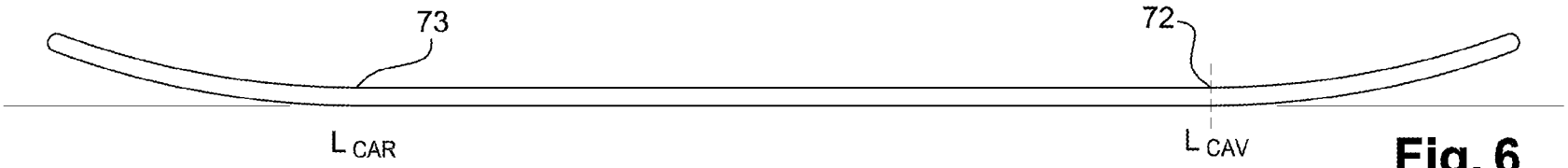
FIG. 6 is a side view of the snowboard of FIG. 5, shown to be loaded at its center.

As illustrated in FIG. 6, snowboard 51 has a front contact line 72, defined in standardized fashion when the board is loaded at its center, and extends on a horizontal plane.

In the shape illustrated in FIG. 6, front contact line 72 is located slightly to the back of widest line 70, and thus in front adjacent area 61 of the sidecut. Similarly, rear contact line 73 is located slightly ahead of line 71 of maximum width, and thus in rear adjacent area 62 of the sidecut.

Figure 7:
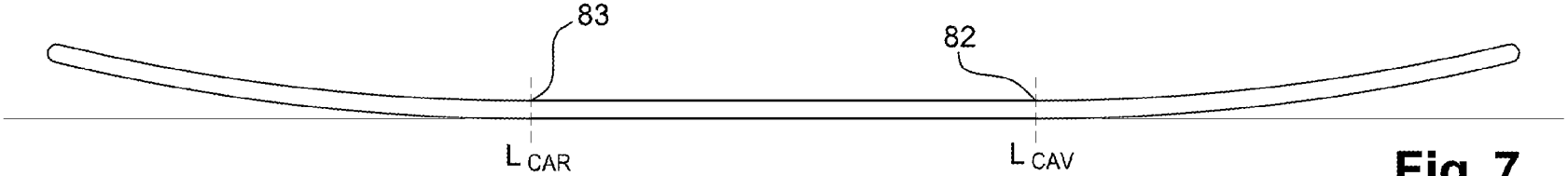
FIG. 7 is a side view of an alternative embodiment of a snowboard having a load-bearing length shorter than that of FIG. 6.

In an alternative embodiment illustrated in FIG. 7, front contact line 82 is located more to the back than front contact line 72 of the board of FIG. 6. More specifically, front contact line 82 is located close to the separation line between central area 60 and adjacent area 61, in the binding installation region. According to different variations, front contact line 82 may be located in the adjacent area or in the central area.

Of course, the two embodiments illustrated in FIGS. 6 and 7 may be combined in the case of a board having different tip raisings from one side to the other.

As appears from the foregoing, boards according to the present invention have the advantage of limiting overpressures exerted at the widest points of the sidecut when the board is inclined on the edge, which eases the board control and steerability. The over-pressure is all the smaller as the adjacent area is long.

The invention claimed is:

1. A snow gliding board, comprising a front line of maximum width, and having sidecuts comprising a central area having a curvature directed towards the outside of the board, wherein said central area ends at a first point located before said front line of maximum width, said board including an adjacent area which extends towards the front from said first point, said adjacent area having a curvature directed towards the inside, said adjacent area ending at a second point, said second point being located at or beyond the front line of maximum width.

2. The gliding board of claim 1, wherein the length of the portion of the adjacent area located before the line of maximum width, measured parallel to the longitudinal axis of the board, is greater than 120 mm.

3. The gliding board of claim 1, having a front contact line located in the central area.

4. The gliding board of claim 1, having a front and/or rear contact line located in the adjacent area.

5. The gliding board of claim 1, wherein the length of the adjacent area before the line of maximum width, measured parallel to the longitudinal axis of the board, is greater than 10% of the length measured between the lines of maximum width.

6. The gliding board of claim 1, wherein the radius of curvature of the central area is smaller than the radius of curvature of the adjacent area.

7. The snowboard of claim 1, wherein the radius of curvature of the central area ranges between 5 m and 20 m.

8. The gliding board of claim 1, wherein the radius of curvature of the adjacent area before the line of maximum width ranges between 15 m and 30 m.

9. The gliding board of claim 1 forming an alpine ski, wherein the radius of curvature of the central area is smaller than or equal to 15 m.

10. The gliding board of claim 9, wherein the adjacent area has a curvature directed towards the inside are located at the front of a waist of the gliding board.

11. The gliding board of claim 9, comprising two adjacent areas having their curvature directed towards the inside, located at a front and at a back of a waist of the gliding board.

12. The gliding board of claim 9, having a minimum width at a waist central area greater than 100 mm.

13. The gliding board of claim 9, wherein the first point, and the point of maximum width are transversely offset by at least 5 mm.

14. The gliding board of claim 1, forming a snowboard, wherein the radius of curvature of the central area is smaller than or equal to 8 m.

15. The gliding board of claim 1, wherein the board width varies along said adjacent area by at least 5 mm.

16. A snow gliding board, comprising a rear lines of maximum width, and having sidecuts comprising a central area having a curvature directed towards the outside of the board, wherein said central area ends at a first point located before said rear line of maximum width, said board including an adjacent area which extends backwards the rear from said first point, said adjacent area having a curvature directed towards the inside, said adjacent area ending at a second point, said second point being located at or beyond the rear line of maximum width.

17. The gliding board of claim 16, wherein the length of the portion of the adjacent area located before the rear line of maximum width, measured parallel to the longitudinal axis of the board, is greater than 120 mm.

18. The gliding board of claim 16, having a rear contact line located in the central area.

19. The gliding board of claim 16, having a rear contact line located in the adjacent area.

20. The gliding board of claim 16, wherein the length of the adjacent area before the line of maximum width, measured parallel to the longitudinal axis of the board, is greater than 10% of the length measured between the lines of maximum width.

21. The gliding board of claim 16, wherein the radius of curvature of the central area is smaller than the radius of curvature of the adjacent area.

22. The snowboard of claim 16, wherein the radius of curvature of the central area ranges between 5 m and 20 m.

23. The gliding board of claim 16, wherein the radius of curvature of the adjacent area before the line of maximum width ranges between 15 m and 30 m.

24. The gliding board of claim 16 forming an alpine ski, wherein the radius of curvature of the central area is smaller than or equal to 15 m.

25. The gliding board of claim 16, forming a snowboard, wherein the radius of curvature of the central area is smaller than or equal to 8 m.

26. The gliding board of claim 16, wherein the board width varies along said adjacent area by at least 5 mm.

27. The gliding board of claim 24, wherein the adjacent area has a curvature directed towards the inside located at the rear of a waist of the gliding board.

28. The gliding board of claim 24, comprising an adjacent area having a curvature directed towards the inside, located at the front and the back of a waist of the gliding board.

29. The gliding board of claim 24, having a minimum width at a waist central area greater than 100 mm.

30. The gliding board of claim 24, wherein the first point and the point of maximum width are transversely offset by at least 5 mm.

31. The gliding board of claim 24, comprising two adjacent areas having their curvature directed towards the inside, located at the a front and at the a back of a waist of the gliding board.

* * * * *